US007158650B2

(12) United States Patent
Furuya et al.

(10) Patent No.: US 7,158,650 B2
(45) **Date of Patent: *Jan. 2, 2007**

(54) ELECTROACOUSTIC TRANSDUCER

(75) Inventors: Masahito Furuya, Yamanashi-ken (JP); Hironori Kuwabara, Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 421 days.

This patent is subject to a terminal disclaimer.

(21) Appl. No.: 10/778,217

(22) Filed: Feb. 17, 2004

(65) Prior Publication Data

US 2004/0161125 A1 Aug. 19, 2004

(30) Foreign Application Priority Data

Feb. 18, 2003 (JP) ..... 2003-039256

(51) Int. Cl.
*H04R 25/00* (2006.01)

(52) U.S. Cl. ..... 381/396; 381/398

(58) Field of Classification Search ..... 381/189, 381/395, 396, 398, 431; 181/171, 172, 173
See application file for complete search history.

(56) References Cited

U.S. PATENT DOCUMENTS 6,834,114 B1 * 12/2004 Kobayashi et al. ..... 381/396
6,845,168 B1 * 1/2005 Kuwabara et al. ..... 381/409
7,010,140 B1 * 3/2006 Furuya ..... 381/396

* cited by examiner

*Primary Examiner*—Curtis Kuntz
*Assistant Examiner*—Tuan Duc Nguyen
(74) *Attorney, Agent, or Firm*—Birch, Stewart, Kolasch & Birch, LLP

(57) ABSTRACT

An electroacoustic transducer has an annular permanent magnet provided in a frame, and an annular top plate mounted on the permanent magnet. A ring is secured to the upper surface of the top plate. A diaphragm is secured to the ring.

5 Claims, 6 Drawing Sheets

ELECTROACOUSTIC TRANSDUCER

This Non-provisional application claims priority under 35 U.S.C. § 119(a) on Patent Application No. 2003-039256 filed in JAPAN on Feb. 18, 2003, the entire contents of which are hereby incorporated by reference.

BACKGROUND OF THE INVENTION

The present invention relates to an electroacoustic transducer such as a loud speaker and receiver used in a portable communication equipment.

In recent years, a small dynamic speaker having a thin thickness and a good performance is widely used as an electroacoustic transducer in a portable communication equipment such as a portable telephone.

A conventional speaker will be described hereinafter with reference to drawings.

FIG. 7 is a plan view showing a conventional dynamic speaker, FIG. 8 is a sectional view taken along a line VIII—VIII of FIG. 7, and FIG. 9 is a plan view as viewed from the underside of the speaker.

The dynamic speaker 1 has an elliptic frame 2 made of resin. The frame 2 comprises a bottom 3 having a circular hole 4 and a peripheral projection 5 having an annular step 6. An annular yoke 7 having a central projection 8 is secured to the bottom 3 of the frame 2. An annular permanent magnet 10 is secured to the yoke 7, and an annular top plate 11 is mounted on the permanent magnet 10. Outside walls of the yoke 7, permanent magnet 10 and top plate are contacted with the inside wall 5*a* of the peripheral projection 5 of the frame 2.

An elliptic diaphragm 13 made of plastic has a central spherical portion 13*a*, annular peripheral portion 13*b* and an annular peripheral flat portion 13*c*. The peripheral flat portion 13*c* is secured to the step 6 of the peripheral projection 5 of the frame 2.

An annular voice coil 15 is secured to the underside of the diaphragm 13. Both ends of the voice coil 15 are connected to terminal plates 16 provided on the underside of a pair of projections 17 of the frame 2. The voice coil 15 is inserted in a magnetic gap 18 formed between the central projection 8 of the yoke 7 and the top plate 11. A protector 20 made of a light metal plate is secured to the peripheral flat portion 13*c* of the diaphragm 13 at a peripheral edge 20*a* by an adhesive 21. A plurality of sound discharge holes 22 are formed in the protector 20, communicating with an upper space 23, and a pair of sound discharge holes 24 are formed in the bottom 3 of the frame 2, communicating with a lower space 25.

In the above described conventional speakers, the diaphragm 13 is secured to the step 6 of the peripheral projection 5. Therefore, the diameter of the diaphragm is reduced by the width of the step 6. Therefore, a large magnetic force can not be obtained, and hence a sufficient sound pressure can not be produced.

SUMMARY OF THE INVENTION

An object of the present invention is to provide an electroacoustic transducer which may increase the diameter of the magnet, thereby increasing sound pressure.

According to the present invention, there is provided an electroacoustic transducer comprising a frame having a peripheral projection, a yoke made of magnetic material and secured to the frame, an annular permanent magnet provided in the frame, a diaphragm having a peripheral portion, a voice coil secured to an underside of the diaphragm, and a protector secured to the frame, characterized in that a ring is secured to a part provided in the frame at a position adjacent the peripheral projection of the frame, the diaphragm is secured to the ring.

An annular top plate is mounted on the permanent magnet.

The part is the annular top plate.

Further, there is provided an electroacoustic transducer comprising a first electroacoustic transducer and a second electroacoustic transducer which are provided back to back in a frame, the first electroacoustic transducer comprising the frame having a peripheral projection, a yoke made of magnetic material and secured to the frame, the yoke having a central recess and a flange, a first annular permanent magnet secured to an underside of the flange of the yoke, a first annular top plate secured to the first permanent magnet, a first diaphragm having a peripheral portion, a first voice coil secured to the diaphragm, and a fist protector secured to the frame, the second electroacoustic transducer comprising a second permanent magnet secured to a bottom of the recess of the yoke, a second top plate secured to the second permanent magnet, a second diaphragm having a peripheral portion, a second voice coil secured to the second diaphragm, and a second protector secured to the frame, characterized in that a ring is secured to the first top plate and to the frame at a position adjacent the peripheral projection of the frame, the first diaphragm is secured to the ring.

These and other objects and features of the present invention will become more apparent from the following detailed description with reference to the accompanying drawings.

DETAILED DESCRIPTION OF THE PREFERRED EMBODIMENT

An embodiment of the present invention will be described hereinafter with reference to drawings.

Figure 1:
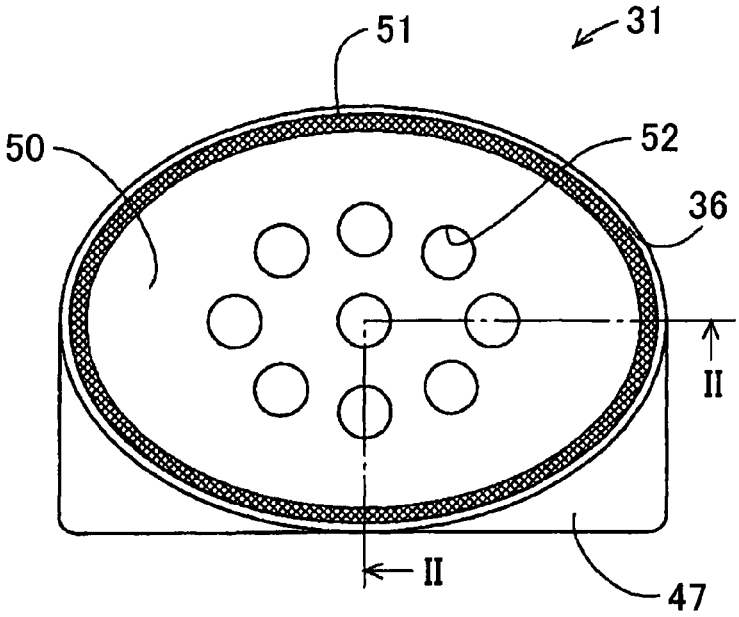
FIG. 1 is a plan view showing a dynamic speaker according to a first embodiment of the present invention.
Figure 2:
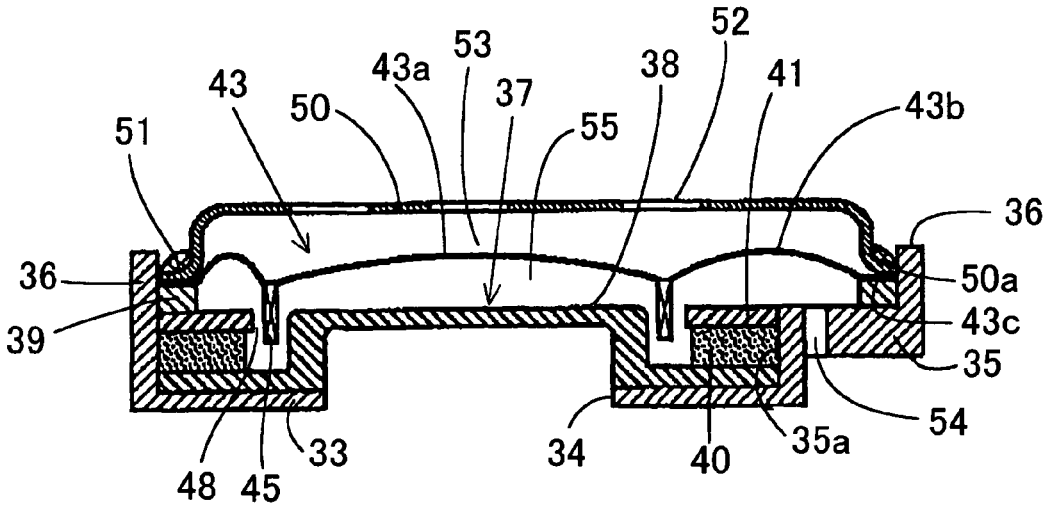
FIG. 2 is a sectional view taken along a line II—II of FIG. 1.
Figure 3:
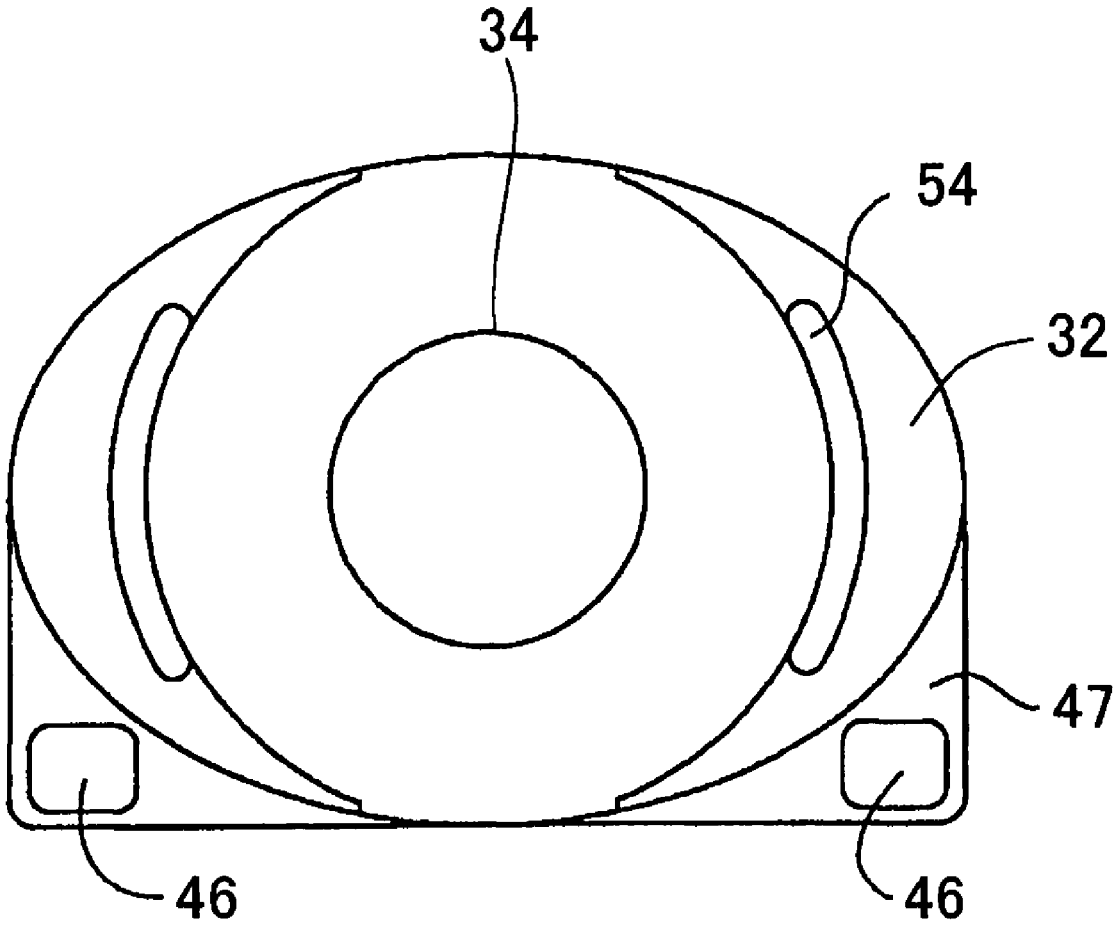
FIG. 3 is a plan view as viewed from the underside of the speaker.

FIG. 1 is a plan view showing a dynamic speaker according to an embodiment of the present invention, FIG. 2 is a sectional view taken along a line II—II of FIG. 1, and FIG. 3 is a plan view as viewed from the underside of the speaker.

The dynamic speaker 31 has an elliptic frame 32 made of resin. The frame 32 comprises a bottom 33 having a circular hole 34, and a pair of projections 35 formed on both sides of the long axis of the elliptic frame, and an annular peripheral projection 36. An annular yoke 37 having a cylindrical central projection 38 is secured to the bottom 33 of the frame 32. An annular permanent magnet 40 is secured to the yoke 37, and an annular top plate 41 is mounted on the permanent magnet 40. The upper surface of the top plate 41 is coplanar with the upper surface of each projection 35 as shown in FIG. 2. Outside walls of the yoke 37, permanent magnet 40 and top plate 41 are contacted with the inside wall 35*a* of the frame 32.

An elliptic diaphragm 43 made of plastic has a central spherical portion 43*a*, annular peripheral portion 43*b* and an annular peripheral flat portion 43*c*.

In accordance with present invention, an elliptic ring 39 is secured to upper surfaces of projections 35 and the top plate 41. The peripheral flat portion 43*c* is secured to the ring 39.

An annular voice coil 45 is secured to the underside of the diaphragm 43. Both ends of the vice coil 45 are connected to terminal plates 46 provided on the underside of a pair of projections 47 of the frame 32. The voice coil 45 is inserted in a magnetic gap 48 formed between the outside wall of the central projection 38 of the yoke 37 and the top plate 41. A protector 50 made of a light metal plate is secured to the peripheral flat portion 43*c* of the diaphragm 43 at a peripheral edge 50*a* by an adhesive 51. A plurality of sound discharge front holes 52 are formed in the protector 50, communicating with an upper space 53, and a pair of sound discharge rear holes 54 are formed in the bottom 33 of the frame 32, communicating with a lower space 55.

Since a step is not formed in the peripheral projection unlike the conventional speaker, the width of the peripheral projection can be reduced as shown in the left side of FIG. 2, so that the diameter of the magnet can be increased.

Figure 4:
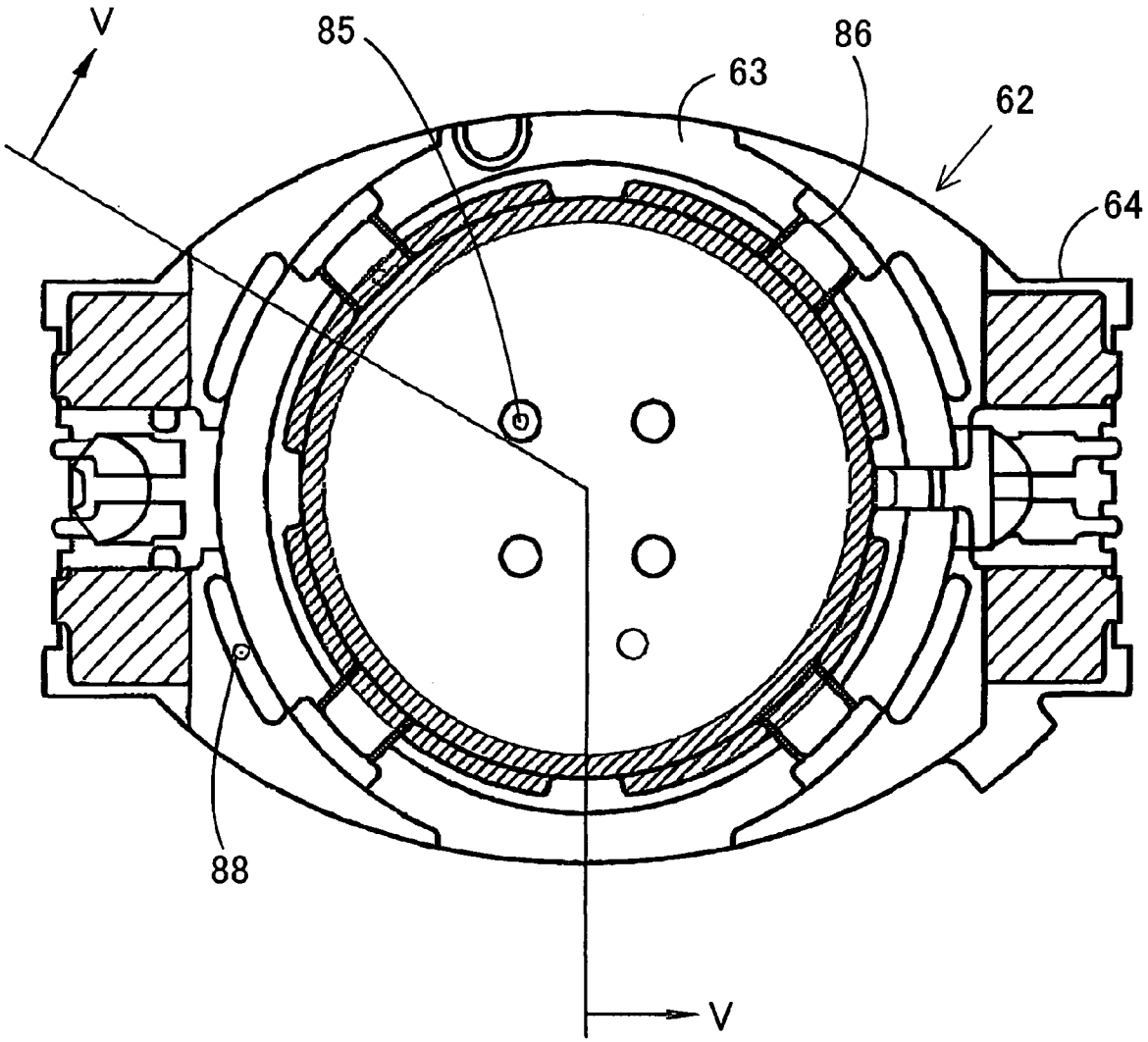
FIG. 4 is a plan view of an electroacoustic transducer of a second embodiment of the present invention.
Figure 5:
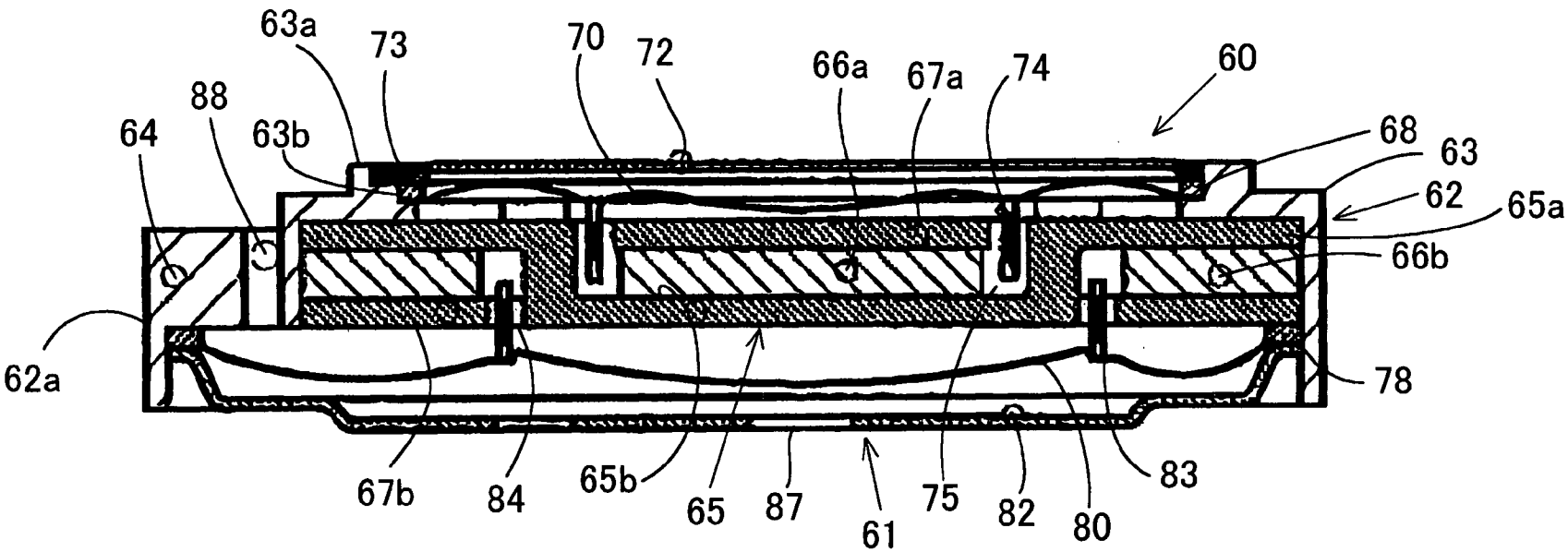
FIG. 5 is a sectional view taken along a line V—V of FIG. 4.
Figure 6:
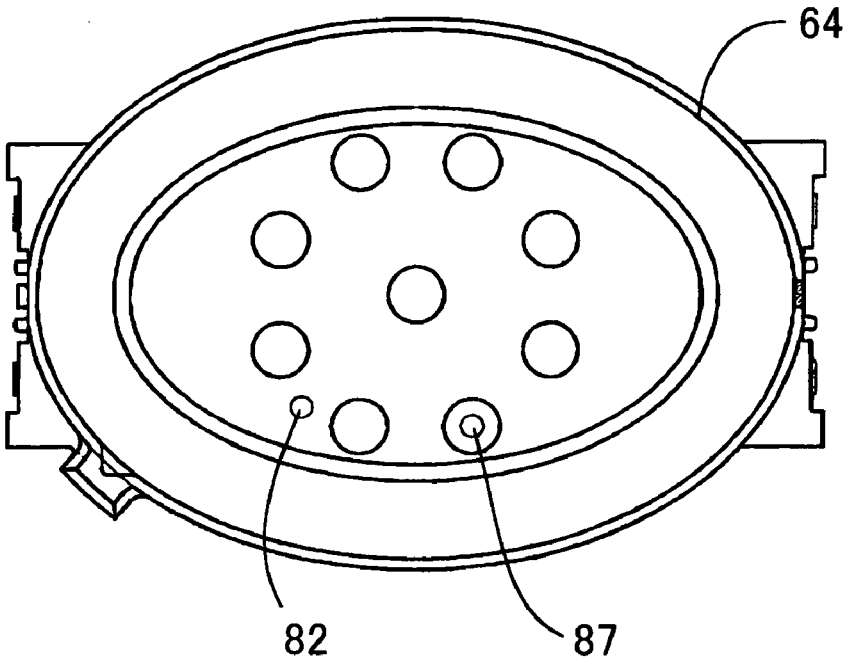
FIG. 6 is a plan view as viewed from the underside of the second embodiment of the present invention.
Figure 7:
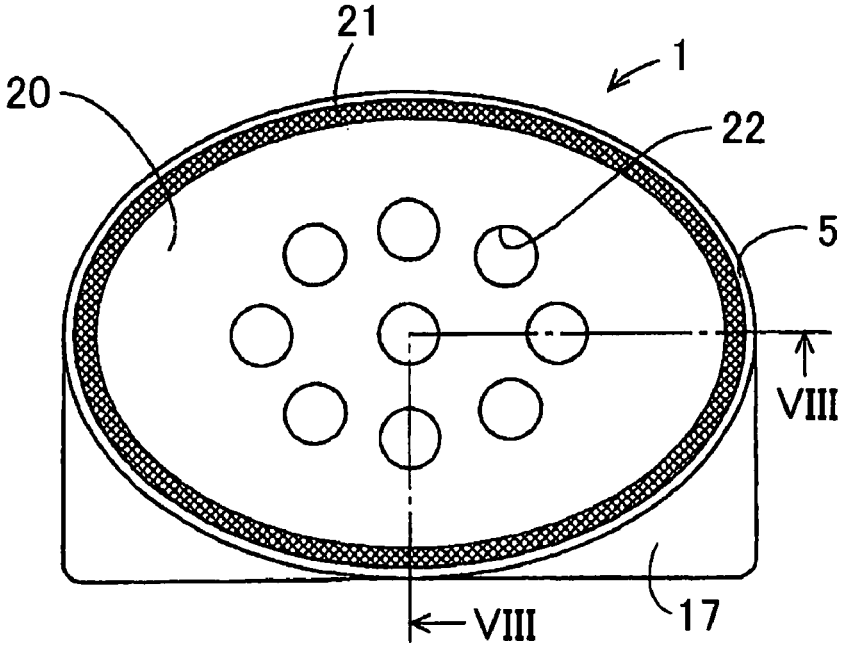
FIG. 7 PRIOR ART
FIG. 7 is a plan view showing a conventional dynamic speaker.
Figure 8:
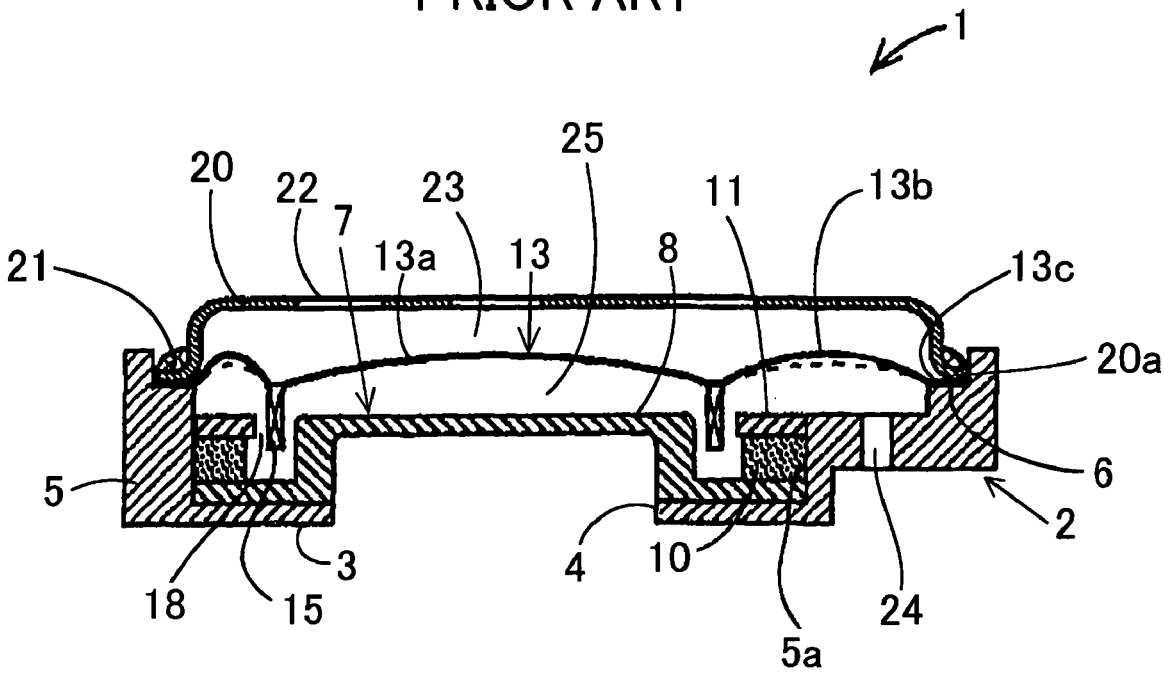
FIG. 8 PRIOR ART
FIG. 8 is a sectional view taken along a line VIII—VIII of FIG. 7.
Figure 9:
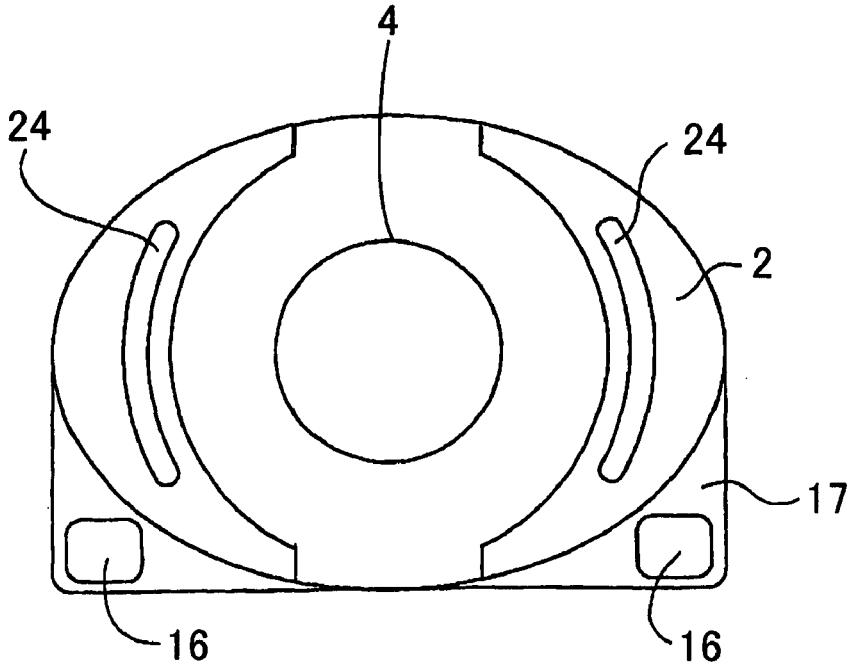
FIG. 9 PRIOR ART
FIG. 9 is a plan view as viewed from the underside of the speaker.

FIG. 4 is a plan view of an electroacoustic transducer of a second embodiment of the present invention, FIG. 5 is a sectional view taken along a line V—V of FIG. 4, FIG. 6 is a plan view as viewed from the underside of the device.

The electroacoustic transducer of the second embodiment is characterized by integrally combining a speaker and a receiver used in a portable telephone. The receiver is provided as a telephone ringer which produces an audible calling signal.

The electroacoustic transducer comprises a receiver 60 and a speaker 61, provided in an integral frame 62. The integral frame 62 comprises a first frame part 63 for the receiver 60 and a second frame part 64 for the speaker 61. The first frame part 63 has a circular shape in plan view, and the second frame part 64 has an ellipse shape in plan view as shown in FIG. 6.

In the integral frame 62, there is provided a common yoke 65 having a flange 65*a* and a central recess 65*b*, a central first permanent magnet 66*a* adhered to the yoke, an annular second permanent magnet 66*b* secured to the underside of the flange 65*a*, a first top plate 67*a* secured to the upper surface of the first permanent magnet 66*a*, and a second top plate 67*b* secured to the underside of the second permanent magnet 66*b*.

As shown in FIG. 5, the first frame part 63 of the receiver 60 has a peripheral annular projection 63*a* and step 63*b*.

A diaphragm 70 is mounted on the step 63*b* at a periphery thereof and is secured to the first frame part 63 by a ring 68. A peripheral portion of a protector 72 is secured to the ring 68 by an adhesive 73.

A voice coil 74 of the diaphragm 70 is inserted in a first magnetic gap 75 between the yoke 65 and the first top plate 67*a*.

On the other hand, in the second frame part 64 for the speaker 61, a ring 78 is secured to the second top plate 67*b* and to undersides of projected portions 62*a* of the frame 62. A diaphragm 80 is secured to the ring 78, and a protector 82 is secured to the diaphragm 80. A voice coil 83 of the diaphragm 80 is inserted in a second magnetic gap 84 formed between the yoke 65 and the second top plate 67*b*.

Receiver sound discharge front holes 85 are formed in the protector 72 and rear holes 86 are formed in the first frame part 63, and speaker sound discharge front holes 87 are formed in the protector 82 and rear holes 88 are formed in the second frame part 64.

In accordance with the present invention the diameter of the magnet can be increased, so that the magnetic force, and hence the sound pressure may by increased.

While the invention has been described in conjunction with preferred specific embodiment thereof, it will be understood that this description is intended to illustrate and not limit the scope of the invention, which is defined by the following claims.

What is claimed is:

1. An electroacoustic transducer comprising:

a frame having a peripheral projection;

a yoke made of magnetic material and secured to the frame;

an annular permanent magnet provided in the frame;

a diaphragm having a peripheral portion;

a voice coil secured to an underside of the diaphragm; and a protector secured to the frame, characterized in that a ring is secured to a part provided in the frame at a position adjacent the peripheral projection of the frame, the diaphragm is secured to the ring.

2. The electroacoustic transducer according to claim 1 wherein an annular top plate is mounted on the permanent magnet.

3. The electroacoustic transducer according to claim 2 wherein the part is the annular top plate.

4. The electroacoustic transducer according to claim 2 wherein the part comprises the top plate and upper surfaces of the frame.

5. An electroacoustic transducer comprising:

a first electroacoustic transducer and a second electroacoustic transducer which are provided back to back in a frame, the first electroacoustic transducer comprising:

the frame having a peripheral projection;

a yoke made of magnetic material and secured to the frame;

the yoke having a central recess and a flange;

a first annular permanent magnet secured to an underside of the flange of the yoke;

a first annular top plate secured to the first permanent magnet;

a first diaphragm having a peripheral portion;

a first voice coil secured to the diaphragm; and a fist protector secured to the frame, the second electroacoustic transducer comprising:

a second permanent magnet secured to a bottom of the recess of the yoke;

a second top plate secured to the second permanent magnet;

a second diaphragm having a peripheral portion;

a second voice coil secured to the second diaphragm; and a second protector secured to the frame, characterized in that a ring is secured to the first top plate and to the frame at a position adjacent the peripheral projection of the frame, the first diaphragm is secured to the ring.

* * * * *